United States Patent [19]

Lostumo

[11] Patent Number: 5,028,905

[45] Date of Patent: Jul. 2, 1991

[54] HIGH VOLTAGE COIL HAVING SPLIT PLASTIC TUBES

[75] Inventor: Arthur J. Lostumo, Franklin Park, Ill.

[73] Assignee: Zenith Electronics Corporation

[21] Appl. No.: 610,176

[22] Filed: Nov. 7, 1990

Related U.S. Application Data

[62] Division of Ser. No. 557,436, Jul. 23, 1990.

[51] Int. Cl.[5] ..... H01F 27/30

[52] U.S. Cl. ..... 336/205; 29/605; 336/206; 336/208

[58] Field of Search ..... 336/198, 205, 206, 208, 336/209, 96; 29/605; 264/272.15, 272.19, 263

[56] References Cited

U.S. PATENT DOCUMENTS

| | | | |
|---|---|---|---|
| 1,495,823 | 5/1924 | Underhill | 336/206 |
| 1,529,973 | 3/1925 | Underhill | 336/206 |
| 2,392,790 | 1/1946 | Webb | 336/205 |
| 3,358,256 | 12/1967 | Naito et al. | 336/208 |
| 4,768,856 | 9/1988 | Hofmann et al. | 336/206 |

*Primary Examiner*—Thomas J. Kozma

[57] ABSTRACT

A high voltage coil manufactured by alternately winding coils and mounting rigid insulating tubes on a coil form having end plates with terminals. After each coil is wound with its ends terminated at the end plates, a first axially slitted insulator tube is snapped over the coil with about a one-quarter inch gap and a second tube with no gap is snapped over the first rotationally displaced 180 degrees enclosing the gap which forms a flow conduit. Another coil is wound on the second tube and the process is repeated to form as many as six coils. Potting material is applied to the completed assembly and vacuum impregnated, and the tube conduits form flow paths to achieve complete impregnation.

2 Claims, 2 Drawing Sheets

HIGH VOLTAGE COIL HAVING SPLIT PLASTIC TUBES

Cross-Reference to Related Application

This application is a division of application Ser. No. 577,436, filed Jul. 23, 1990.

BACKGROUND OF THE INVENTION

The present invention is exemplified by a high voltage coil for projection television systems, but it should be understood that the present coil may find utility in a variety of high voltage coil applications where a plurality of electrically isolated coils are formed on the same coil form.

In the past two methods have been employed in the manufacture of high voltage coils. The first utilizes an automatic coil winding machine that wraps layers of coil wire, terminating each coil on pins on coil form end plates. After each coil is wound, and at the same station, a plurality of layers of Mylar insulator are wrapped on each coil by an automated winding device.

While this process has acheived a significant degree of commercial success, it has several disadvantages. One is that the Mylar insulators, because they are wrapped by automatic winding machinery, are wound so tightly against its own layers, against the underlying coil and also against the coil formed end plates, that complete impregnation by fluid epoxy, even by advanced vacuum impregnation techniques is not possible on a consistent basis.

The second method of making these high voltage coils is to wind the coils, not on the final coil form with end plates, but instead on separate insulator tubes having increasing diameters so that they may be subsequently concentrically mounted. Then, beginning with the smallest tube and coil assembly, they ate inserted over a coil form with one of the end plates removed. Then, the additional incrementally larger coil and tube assemblies are slid serially over one another until the desired number of coils and tubes are mounted. The previously removed end plate is then reattached to the coil form and the respective coils are terminated at the opposite end plate terminals.

This method, to some extent, ameliorates the problems noted above in the wrapping method because the diameter of the tubes with respect to the outer diameter of the underlying coil can be varied as desired to achieve potting material flow. However, it is diffucult to control the axial gap between the tubes and the end plates and between the coils and the end plates because the tube and coils are formed without the end plates in situ, so that while the inner diameter of the various insulating tubes can be controlled, complete impregnation is not consistently possible because there is no effective way for the epoxy to get down into the coils at the various radial levels of these concentric tubes.

The second method also requires a significant amount of assembly time because the coil is effectively formed in two stages.

It is a primary object of the present invention to ameliorate the problems described above in high voltage coils and their method of manufacture.

DETAILED DESCRIPTION OF THE PREFERRED EMBODIMENT

Figure 1:
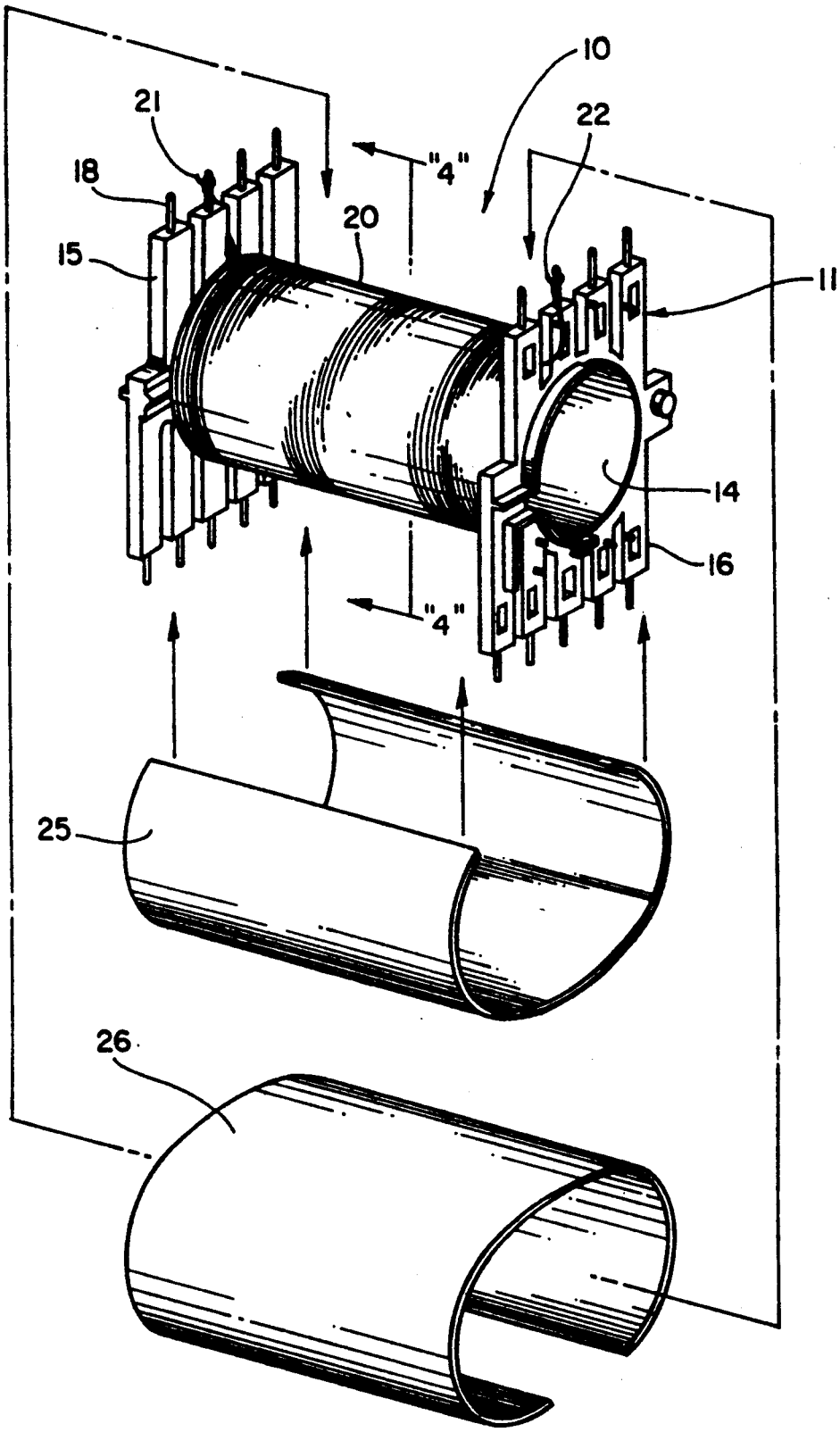
FIG. 1 is an exploded perspective view of the present high voltage coil with one set of insulator tubes exploded away.

In accordance with the present invention, an improved high voltage coil is provided in which the coil is made by alternately winding coils and appluing rigid insulator tubes on a coil form having end plates with terminals. The first coil is wound directly on the form with its ends terminated at the end plates. Thererafter, a first relatively rigid axially split insulator tube is snapped over this first coil leaving about a one-quarter inch gap in the insulator tube. A second similar rigid slit tube is snapped over the first but with no gap, and rotationally disposed 180 degrees with respect to the first tube so that it encloses the gap in the first tube forming a conduit for potting material flow.

Another coil is then wound on the second tube and the process is repeated forming as many coils as desired but usually six for a projection television sweep coil, for example.

Potting material is then applied to the completed assembly and vacuum impregnated into the coils. The concentric insulator tubes have about a 0.100 inch axial gap with the coil form end plates permitting epoxy material to flow immediately radially down to all the coil levels, and it then flows substantially simultaneously axially down each of the tube conduits and then circumferentially around and through the turns of each of the coils providing complete and consistent coil impregnation. This complete and consistent coil impregnation is not possible with the prior art methods described above in the Background of the Invention.

According to the present invention an assembly turret is provided with a plurality of circumferentially spaced coil forms. The coil forms proceed to a first station where the first coil is wound and then move to a second station where the insulator tubes can be either automatically or manually snapped over the previously wound coil. By separating the stations where the insulating tubes are applied and coil winding takes place, considerable time saving is achieved in the manufacturing process over the process described avove where Mylar insulator winding occurs at the same station as coil winding.

Other objects and advantages of the present invention will appear more clearly from the following detailed description.

Referring to the drawings, a high voltage coil assembly 10 is illustrated according to the present invention particularly adapted for high voltage sweep circuitry in projection television systems, but it should be understood that the present coil assembly has application in other high voltage coils where a plurality of electrically independent coils are concentrically wound and insulated from one another.

Figure 4:
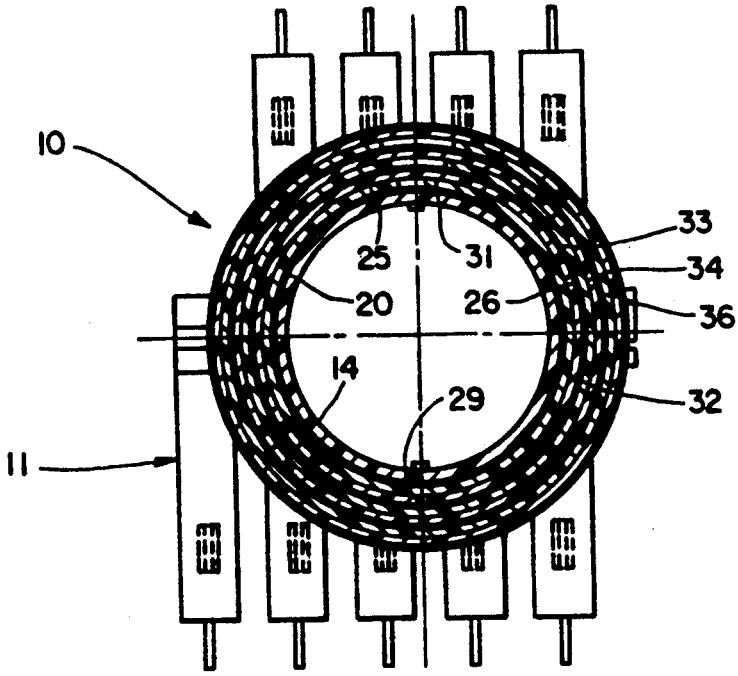
FIG. 4 is an enlarged cross section taken generally along line 4—4 of FIG. 1 illustrating four coils.

As seen in the drawings, and referring particularly to FIGS. 1 and 4, the coil is formed on a plastic coil form 11 that consists of an annular coil form member 14 to which are attached an input terminal end plate 15 and an output terminal end plate 16. The input terminal end plate has a plurality of input termials 18, in this case nine terminals, and the output terminal end plate 11 has a similar number of output terminals.

The coil assembly 10 is particularly designed for six coils (although only four are shown in FIG. 4), and since there are more than six terminals on end plates 15 and 16, the extra terminals are utilized to wire other components such as the necessary sweep diodes between the coils.

After a first coil 20 (see FIG. 4) is wound around the coil form 14, its ends 21 and 22 are connected to terminals 18 and 19 respectively.

Thereafter the insulator tubes 25 and 26 are snapped over the coil 20. The insulator tubes 25 and 26 are Mylar tubes, or other suitable polyester material, having a sufficiently high durometer so that they may be opened and then snapped around the coil 20.

Figure 2:
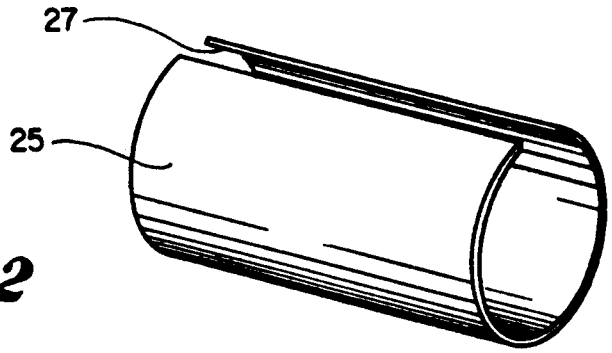
FIG. 2 is a sub-assembly perspective view of the first applied insulator tube in each set.
Figure 3:
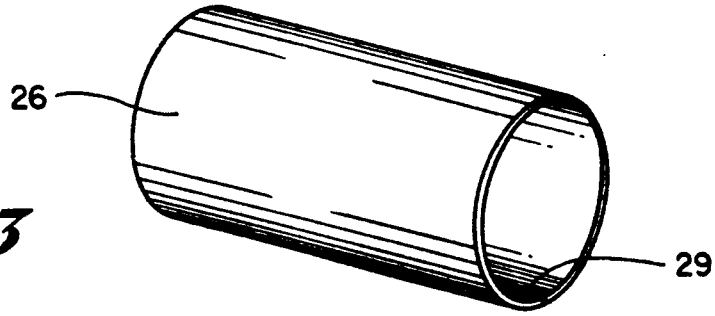
FIG. 3 is a perspective view of the second insulator tube in each set.

The insulator tube 25 is applied first and it is sized, as seen in its relaxed position in FIG. 2, with an axial gap 27. The relaxed inner diameter of tube 25 is slightly less than the outer diameter of the first coil 20 so that it circumferentially slightly hugs the coil, producing a circumferential width of gap 27 after installation of approximately 0.250 inches.

The second insulator tube 26 is constructed of the same material as tube 25 and is also axially slit at 29 but has a relaxed position with the slit 29 closed or abutted and an inner diameter approximately the same as the outer diameter of tube 25 so that after it is mounted around tube 25, the slit remains closed.

As seen in FIG. 4, the second tube 26 is mounted about 180 degrees displaced from tube 25 so that slit 29 is at the bottom and tube 26 covers the gap 27 in tube 25 forming an axially extending conduit 31 extending the entire length of the tubes 25 and 26.

The tubes 25 and 26 have an equal length about 0.200 inches less than the interior spacing between the end plates 15 and 16 so that after mounting on the coils, the tubes 25 and 26 are spaced approximately 0.100 inches from each of the end plates 15 and 16. It is this spacing that defines the radial flow path for potting material as it moves radially inwardly to the coils during impregnation.

Thereafter a second coil 32 is wound over tube 26 and another set of insulator tubes 33 and 34 are mounted over coil 32 in the same way as tubes 25 and 26. The process is repeated adding a third coil 36 and additional tubes until the final total number of coils and tubes have been added, although the outermost coil does not need to be surrounded by insulator tubes because there is no problem in potting the outermost coil.

The completed coil assembly is then covered with a fluid epoxy potting material and placed into a vacuum device, well known in the art, to effect vacuum impregnation into the coils 20, 32, 36, etc. During impregnation, epoxy material flows radially down the end plates 15 and 16 through the intermediate coils and through the 0.100 inch spacing between the insulator tubes and the end plates. Then, the material flows axially through the gaps or conduits 31 approximately all at the same time and into the underlying coil from where material flows circumferentially around and into the underlying coil effecting complete potting.

One of the advantages of the present invention is that the coil winding operation can be performed seperately from the insulating tube mounting. To take advantage of this capability, the coils 10 are assembled on a turret having a plurality of coil from holders circumferentially disclosed thereon. The turret is indexed between work stations with the first consisting of a winding station for the first coil 20. The turret is then indexed so that the coil form with the first coil 20 is moved to a second station where the tubes 25 and 26 are snapped over the coil either manually or by a radially movable assembly arm. The coil form is then indexed to a third station where the second coil is wound and to a fourth station for the insulator tubes, and these steps repeat serially for each coil and tubes until the completed coil reaches an unloading station. By utilizing this turret operation, the coils can be made in a significantly lesser time than in the previously described Mylar insulator winding process where the Mylar is wound at the same station as the coil.

I claim:

1. A coil assembly, comprising: a coil form having end plates and terminals to which individual coils may be connected, a first coil wound on the coil form, a first relatively rigid split plastic tube surrounding the first coil and having an axial gap defining an axial conduit, a second relatively rigid split plastic tube surrounding the first tube but having no significant axial gap, said second tube being rotationally misaligned with the first tube to enclose the gap in the first tube and define the axial conduit, a second coil around the second tube, and a potting material impregnating the coils extending around the second coil through the second coil into the insulator conduit, through the conduit axially and into the first coil.

2. A coil assembly as defined in claim 1, including a third relatively rigid split plastic tube surrounding the second oil and having an axial gap defining a second axial conduit, a fourth relatively rigid split plastic tube surrounding the first tube but having no significant axial gap, said fourth tube being rotationally misaligned with the third tube to enclose the gap in the third tube and define the second axial conduit, a third coil wound on the fourth tube, said potting material surrounding and extending through the third coil into the second conduit.

* * * * *